US011839885B2

(12) United States Patent
Huang et al.

(10) Patent No.: US 11,839,885 B2
(45) Date of Patent: Dec. 12, 2023

(54) ROTARY ATOMIZATION DEVICE

(71) Applicant: Powerbeauty (dongguan) industrial co., ltd., Guangdong (CN)

(72) Inventors: Guangquan Huang, Guangdong (CN); Yiqun Xu, Guangdong (CN)

(73) Assignee: POWERBEAUTY (DONGGUAN) INDUSTRIAL CO., LTD., Dongguan (CN)

( * ) Notice: Subject to any disclaimer, the term of this patent is extended or adjusted under 35 U.S.C. 154(b) by 20 days.

(21) Appl. No.: 17/656,469

(22) Filed: Mar. 25, 2022

(65) Prior Publication Data

US 2022/0212212 A1 Jul. 7, 2022

(30) Foreign Application Priority Data

Jan. 11, 2022 (CN) ..... 202210029511.0

(51) Int. Cl.
*B05B 3/02* (2006.01)
*B05B 7/24* (2006.01)

(52) U.S. Cl.
CPC ..... *B05B 3/025* (2013.01); *B05B 7/2491* (2013.01)

(58) Field of Classification Search
CPC ..... B05B 3/025; B05B 3/027; B05B 7/2491; B05B 17/0607
USPC ..... 239/102.2, 263.1
See application file for complete search history.

(56) References Cited

U.S. PATENT DOCUMENTS

| | | | |
|---|---|---|---|
| 4,632,152 | A | 12/1986 | Pezzoli |
| 5,693,266 | A | 12/1997 | Jung |
| 10,385,867 | B2 | 8/2019 | Song |
| 2010/0224697 | A1 | 9/2010 | Modlin et al. |

OTHER PUBLICATIONS

Extended European Search Report of its family patent application EP22166034.3, dated Sep. 27, 2022.

*Primary Examiner* — Christopher S Kim
(74) *Attorney, Agent, or Firm* — SHIMOKAJI IP

(57) ABSTRACT

A rotary atomization device includes a housing, a blowing device, a rotating drive device, a rotating shaft, a gas tube and an atomizing structure. The housing has an atomization room and a containing room which are communicated by a gas channel. The blowing device is arranged in the containing room, and the rotating drive device is arranged in the containing room or the atomization room. A drive shaft of the rotating drive device is connected with the rotating shaft connected with the gas tube. One end of the gas tube is arranged in the atomization room and has a gas inlet, and the other end is extended out of the housing and has a gas outlet. The atomizing structure is disposed on the bottom of the atomization room, and the blowing device blows towards the gas channel. The rotary atomization device can realize rotary spraying.

15 Claims, 8 Drawing Sheets

ROTARY ATOMIZATION DEVICE

RELATED APPLICATIONS

This application claims the benefit of priority to Chinese application No. 202210029511.0 filed on Jan. 11, 2022, which is hereby incorporated by reference in its entirety.

FIELD OF THE INVENTION

The present invention relates to the technical field of atomization device, in particular to a rotary atomization device.

BACKGROUND OF THE INVENTION

The existing atomizer generally includes a water tank, an ultrasonic atomization piece, a fan and a spray tube. The ultrasonic atomization piece is used to atomize water in the water tank, and then the fan is used to pressurize the water tank, so that the water mist flows from the spray tube to the outside. However, in the existing atomizer, the spray tube is fixed, and the atomize water is always sprayed in a certain direction for a long time, which will cause the certain space to be too wet and result in the accumulation of water droplets. The water accumulation is produced on the ground, and the use effect is not ideal.

SUMMARY OF THE INVENTION

Objective of the present invention is to provide a rotary atomization device, which can rotate and spray to uniformly humidify the surroundings, so as to avoid the problem of excessive wetness and accumulation of water droplets caused by spraying towards one direction for a long time by existing atomizers.

To achieve the above objective, the present invention provides a rotary atomization device which includes a housing, a blowing device, a rotating drive device, a rotating shaft, a gas tube, and an atomizing structure. The housing is provided with an atomization room for storing liquid and a containing room for separating the liquid in the atomization room, and the containing room is communicated with the atomization room by a gas channel. The blowing device is arranged in the containing room, and the rotating drive device is arranged in the containing room or the atomization room. A drive shaft of the rotating drive device is connected with the rotating shaft, and the rotating shaft is connected with the gas tube. One end of the gas tube is arranged in the atomization room and provided with a gas inlet, and the other end of the gas tube is extended out of the housing and provided with a gas outlet. The atomizing structure is disposed on the bottom of the atomization room to atomize the liquid, the blowing device blows towards the gas channel to blow gas from the atomization room to the gas outlet through the gas inlet, and the rotating drive device drives the rotating shaft to rotate so as to drive the gas outlet of the gas tube to rotate.

Preferably, a waterproof cover is arranged at the bottom of the atomization room, and a containing cavity is formed inside the waterproof cover. The containing cavity is communicated with the containing room and isolated from the atomization room, and the rotating drive device is arranged in the containing room, and the drive shaft is arranged in the containing cavity. In this way, the rotating drive device and the atomization room can be isolated from each other, so as to prevent the mist from moistening the drive device, ensure the operation of the rotary atomization device, and prolong the service life of the rotary atomization device.

Preferably, the drive shaft is provided with a first mounting portion, and the first mounting portion is provided with a first magnet. The rotating shaft is disposed in the atomization room. One end of the rotating shaft facing the first mounting portion is provided with a second mounting portion, and the second mounting portion is provided with a second magnet that attracts the first magnet, so that while the drive shaft rotates, the rotating shaft is driven to rotate by magnetic attraction. The drive shaft and the rotating shaft are isolated by the containing cavity and cannot be mechanically connected. Therefore, by arranging a first magnet on the first mounting portion and a second magnet on the second mounting portion, the drive shaft and the rotating shaft are connected by magnetic attraction. Therefore, when the drive shaft is driven to rotate, the rotating shaft can also be rotated due to magnetic attraction between the first magnet and the second magnet, so as to achieve the purpose of driving the rotating shaft. This arrangement does not affect the rotation of the rotating shaft, and can also achieve the effect of waterproof and moisture-proof. The structure is simple and ingenious.

Preferably, the number of the first magnets is at least two, the first magnets are evenly distributed around a central axis of the drive shaft, and the second magnets are disposed corresponding to the first magnets. In this way, the second mounting portion is balanced by the magnetic attraction, so that the rotating shaft is stably connected to the drive shaft, so as to ensure the stability of rotation.

Preferably, one of a protruding part and a concave part is provided at the center of a top face of the waterproof cover facing the second mounting portion, and the other one of the protruding part and the concave part is provided at the center of a bottom face of the second mounting portion and matched with the protruding part or the concave part at the center of the end face of the waterproof cover. The protruding part and the concave part are movably connected to each other, so that a gap is defined between the bottom face of the second mounting portion and a top surface of the first mounting portion. The gap exists between the bottom face of the second mounting portion and the top surface of the first mounting portion by the protruding part and the concave part, so that friction between the bottom face of the second mounting portion and the top face of the waterproof cover can be avoided. Since frictional resistance can be reduced, the drive shaft can drive the rotating shaft stably and smoothly, and energy consumption can be effectively reduced.

Preferably, both the protruding part and the concave part have a tapered structure, so that a pointed end of the protruding part is in point contact with the bottom of the concave part. In this way, the frictional resistance can be minimized and the energy consumption can be greatly reduced.

Preferably, the waterproof cover is protruded toward the inside of the atomization room.

Preferably, a direction of the gas outlet of the gas tube intersects with a direction of a central axis of the rotating shaft. In this way, when the gas tube is rotated, the gas outlet can be rotated 360 degrees, thereby realizing circumferential spraying and avoiding the accumulation of water droplets in a certain direction.

Preferably, the rotating drive device is arranged in the containing room, the drive shaft extends into the atomization room, and a sealing ring is arranged between the drive shaft and the bottom of the atomization room. The drive shaft extends into the atomization room, and the sealing ring seals the gap between the drive shaft and the atomization room, which prevents the liquid in the atomization room from leaking into the containing room and plays a waterproof role.

Preferably, one end of the drive shaft facing the rotating shaft is provided with a first connecting portion, and the rotating shaft is provided with a second connecting portion which is connected with the first connecting portion. Through the first connecting portion and the second connecting portion, the drive shaft and the rotating shaft can be quickly connected.

Preferably, the first connecting portion is provided with one of a protruding portion and a concave portion, the second connecting portion is provided with the other one of the protruding portion and the concave portion, and the concave portion is circumferentially engaged with the protruding portion. In this way, the concave portion and the protruding portion can be positioned circumferentially quickly, so as to effectively transmit the torque of the drive shaft to the rotating shaft to drive the rotating shaft to rotate.

Preferably, the first connecting portion is formed with a guiding inclined surface, and a bottom surface of the second connecting portion is provided with a matching inclined surface matching with the guiding inclined surface. By forming the guiding inclined surface and the matching inclined surface, the rotating shaft can be quickly positioned and connected to the drive shaft, thereby facilitating assembly.

Preferably, a top surface of the first connecting portion is concaved inward to form a conical structure, and a side wall of the conical structure of the first connecting portion forms the guiding inclined surface, a bottom surface of the second connecting portion protrudes outward to form a conical structure, and a side surface of the conical structure of the second connecting portion forms the matching inclined surface.

Preferably, the rotating drive device is arranged in the atomization room, and the rotating drive device is a waterproof motor.

Preferably, the housing includes a main body and a cover body, a lower part of the main body is provided with the containing room, and the cover body opens or closes on an upper part of the main body, and forms the atomization room with the main body. By assembling the cover body and the main body, the main body can be opened or closed, so that the liquid is filled into the atomization room, which is convenient for use.

In the present invention, an atomization room and a containing room that is used to separate the liquid of the atomization room are arranged in the housing, and a gas channel is arranged between the containing room and the atomization room, and a blowing device is arranged in the containing room, and an atomizing structure and a gas tube are arranged in the atomization room. Therefore, after the liquid is atomized by the atomizing structure, the mist can be discharged from the gas tube to the outside through the blowing device. Furthermore, a rotating drive device drives the gas tube to rotate, so that the gas outlet of the gas tube rotates to realize rotary spraying. The spraying direction can be changed continuously, so as to evenly humidify the surroundings and avoid the problem of excessive wetness and accumulation of water droplets caused by spraying towards one direction for a long time, and the use effect is ideal. In addition, the rotating spraying can also improve the viewing.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
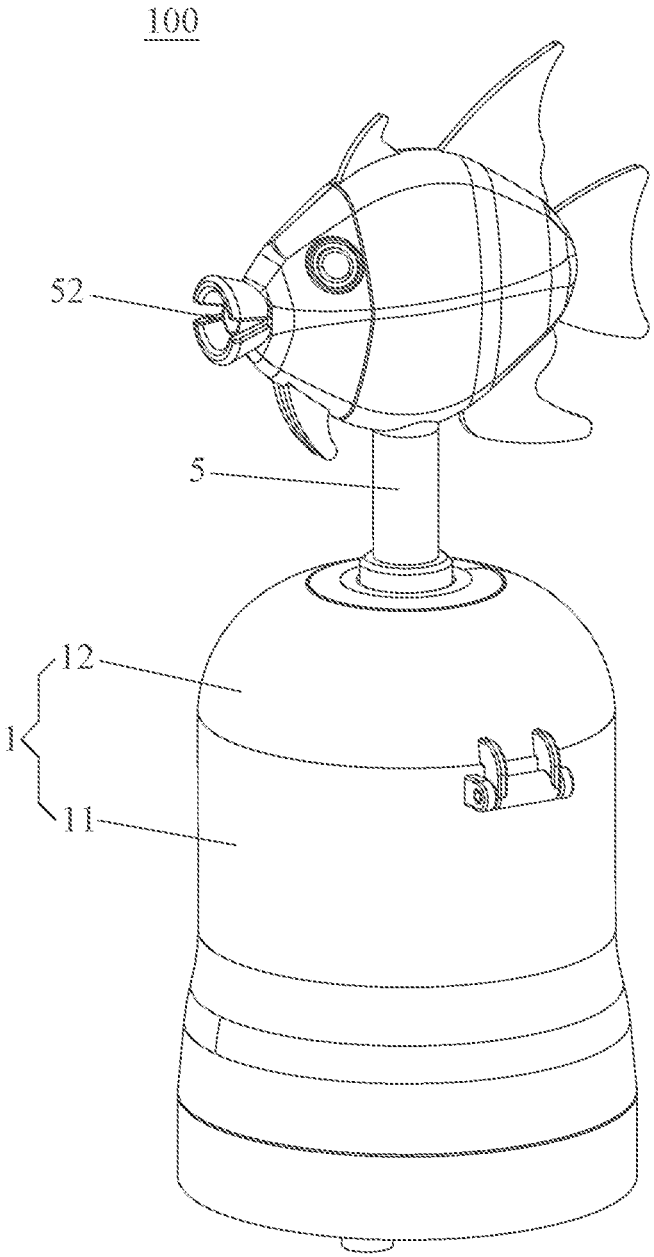
FIG. 1 is a perspective view of a rotary atomization device according to a first embodiment of the present invention.

In order to explain in detail the technical content, construction features, the purpose and effect achieved by the present invention, the following combined with the implementation and the attached drawings are described in detail.

As shown in FIGS. 1 to 5, Figures shows the structure of the rotary atomization device 100 according to a first embodiment of the present invention.

In the first embodiment, the rotary atomization device 100 includes a housing 1, a blowing device 2, a rotating drive device 3, a rotating shaft 4, a gas tube 5 and an atomizing structure 6. The housing 1 has an atomization room 1*a* that can store liquid inside and a containing room 1*b* that isolates the liquid in the atomization room 1*a*. Specifically, the atomization room 1*a* and the containing room 1*b* are arranged up and down, and the containing room 1*b* is located below the atomization room 1*a*. The bottom of the containing room 1*b* communicates with the outside, and the containing room 1*b* is communicated with the atomization room 1*a* by a gas channel 1*c*. Preferably, the gas channel 1*c* is located inside the atomization room 1*a*, and the gas channel 1*c* extends from the containing room 1*b* into the atomization room 1*a*, and further extends above the liquid level in the atomization room 1*a*. The blowing device 2 and the rotating drive device 3 are disposed in the containing room 1*b*, and a drive shaft 31 of the rotating drive device 3 is connected with the rotating shaft 4. In this embodiment, the rotating drive device 3 is a deceleration motor, which can be controlled to start and stop by connecting a control circuit board and a power supply. The rotating shaft 4 is connected with the gas tube 5. One end of the gas tube 5 is arranged in the atomization room 1*a* and provided with a gas inlet 51, and the other end of the gas tube 5 is extended out of the housing 1 and provided with a gas outlet 52. Preferably, a direction of the gas outlet 52 of the gas tube 5 intersects with a direction of a central axis of the rotating shaft 4. Preferably, the gas tube 5 can be divided into two sections, which are assembled during use. The atomizing structure 6 is arranged at the bottom of the atomization room 1*a* to atomize the liquid. Specifically, the atomizing structure 6 is an ultrasonic atomizer which is electrically connected with the control circuit board in the containing room 1*b*. The blowing device 2 blows air to the gas channel 1*c* to blow the mist from the atomization room 1*a* through the gas inlet 51 to the gas outlet 52. Specifically, the blowing device 2 in this embodiment is a fan, but it is not limited to this. The rotating drive device 3 drives the rotating shaft 4 to rotate, so as to further drive the gas outlet 52 of the gas tube 5 to rotate. In this embodiment, the gas tube 5 has an L-shaped structure, and the direction of the gas outlet 52 is perpendicular to the direction of the central axis of the rotating shaft 4. In this way, when the gas tube 5 rotates, the gas outlet 52 can rotate 360 degrees, thereby realizing circumferential spraying and avoiding the accumulation of water droplets in a certain direction. Various decorating parts can be mounted at the gas outlet 52 of the gas tube 5 to enhance the spray effect.

Figure 3:
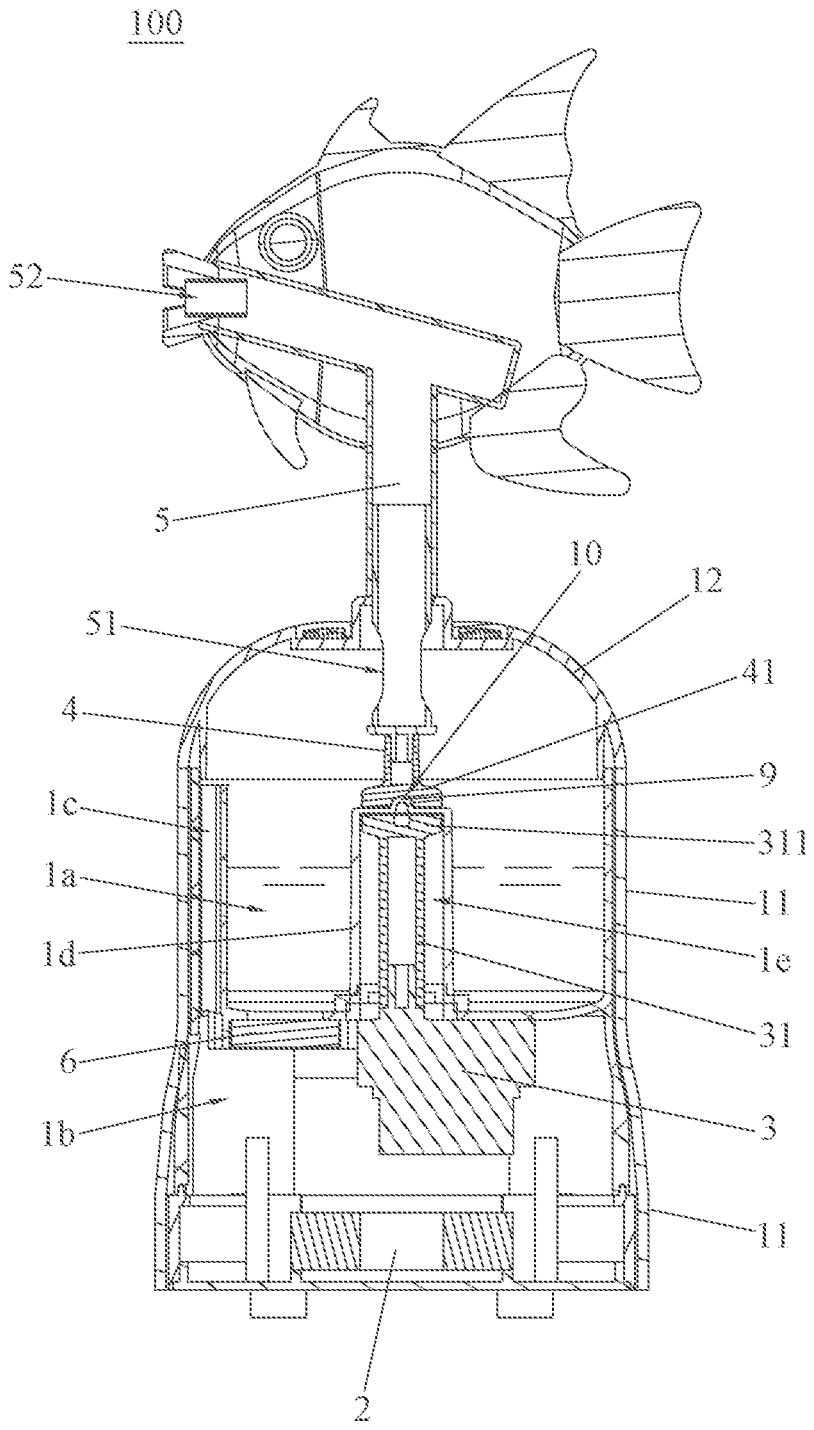
FIG. 3 is a sectional view of the rotary atomization device in FIG. 1.
Figure 4:
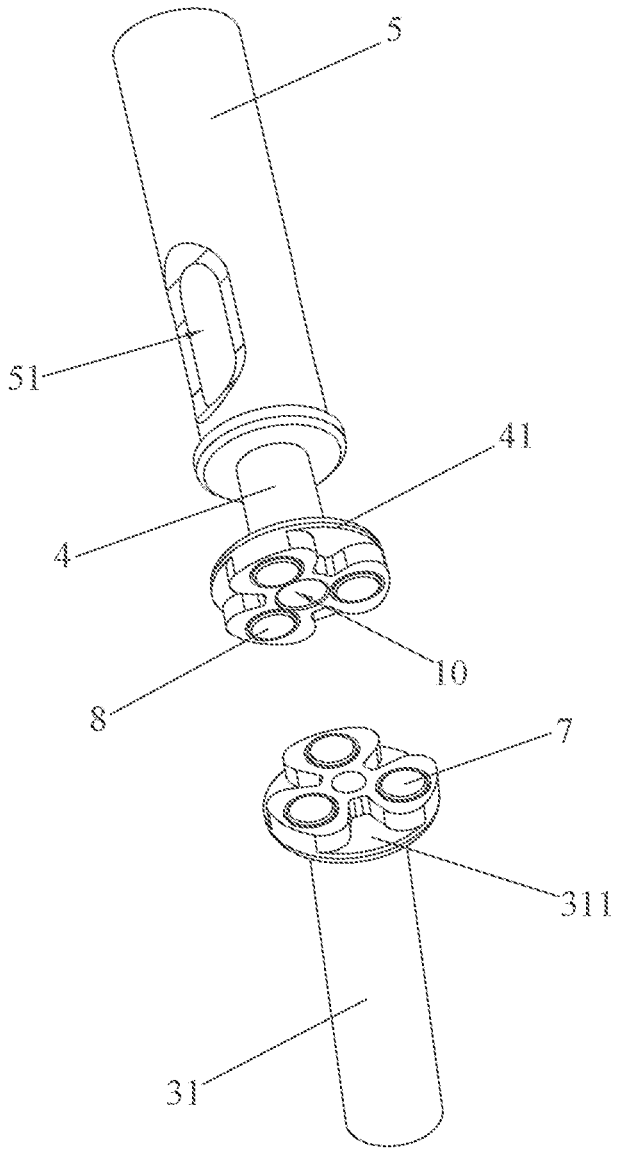
FIG. 4 is an exploded view showing a drive shaft and a rotating shaft in FIG. 1.

Referring to FIGS. 3 and 4, a waterproof cover 1*d* is arranged at the bottom of the atomization room 1*a*, and the waterproof cover 1*d* protrudes toward the inside of the atomization room 1*a*. The waterproof cover 1*d* has a containing cavity 1*e* which communicates with the containing room 1*b* and is isolated from the atomization room 1*a*, and the drive shaft 31 is arranged in the containing cavity 1*e*. In this way, the rotating drive device 3 and the atomization room 1*a* can be completely isolated from each other, thereby preventing the mist from moistening the drive device, ensuring the operation of the rotary atomization device 100, and prolonging the service life. Specifically, the upper end of the drive shaft 31 is provided with a first mounting portion 311, and the first mounting portion 311 is provided with a first magnet 7. The number of the first magnets 7 is at least two, and the first magnets 7 are evenly distributed around a central axis of the drive shaft 31. In this embodiment, the number of the first magnets 7 is three, but it is not limited to this. The rotating shaft 4 is disposed in the atomization room 1*a*. One end of the rotating shaft 4 facing the first mounting portion 311 is provided with a second mounting portion 41, and the second mounting portion 41 is provided with a second magnet 8 that attracts the first magnet 7. Preferably, the rotating shaft 4, the drive shaft 31 and the gas tube 5 are coaxial. When the drive shaft 31 rotates, the rotating shaft 4 is driven to rotate due to magnetic attraction between the first magnet 7 and the second magnet 8. The second magnets 8 are disposed corresponding to the first magnets 7. The second magnets 8 are evenly distributed around the central axis of the rotating shaft 4, and the number of the second magnets 8 is also three, but it is not limited to this. The drive shaft 31 and the rotating shaft 4 are separated by the containing cavity 1*e* and are not mechanically connected. Therefore, by mounting the first magnet 7 on the first mounting portion 311 and the second magnet 8 on the second mounting portion 41, the drive shaft 31 and the rotating shaft 4 are connected by magnetic attraction. Thus, when the drive shaft 31 is driven to rotate, the rotating shaft 4 can also be dirved to rotate due to magnetic attraction between the first magnet 7 and the second magnet 8, so as to drive the rotating shaft 4. This arrangement does not affect the rotation of the rotating shaft 4, and can also achieve the effect of waterproof and moisture-proof. The structure is simple and ingenious. In addition, since multiple first magnets 7 and multiple second magnets 8 are disposed, the second mounting portion 41 is balanced by the magnetic attraction, so that the rotating shaft 4 is stably connected to the drive shaft 31, so as to ensure the stability of rotation.

Referring to FIGS. 3 and 4 again, one of a protruding part 9 and a concave part 10 is provided at the center of a top face of the waterproof cover 1*d* facing the second mounting portion 41, and the other one of the protruding part 9 and the concave part 10 is provided at the center of a bottom face of the second mounting portion 41 and matched with the protruding part 9 or the concave part 10 at the center of the end face of the waterproof cover 1*d*. The protruding part 9 and the concave part 10 are movably connected to each other, so that a gap is defined between the bottom face of the second mounting portion 41 and a top surface of the first mounting portion 311. In this embodiment, the top face of the waterproof cover 1*d* is protruded to form the protruding part 9, and the concave part 10 is formed on the second mounting portion 41. The protruding part 9 gradually tapers outward from the top face of the waterproof cover 1*d*, and the concave part 10 gradually narrows inward from the bottom surface of the second mounting plate 41. More specifically, both the protruding part 9 and the concave part 10 have a tapered structure or a spherical structure, so that a pointed end of the protruding part 9 is in point contact or spherical contact with the bottom of the concave part 10 by the magnetic attraction. In this way, the frictional resistance can be minimized and the energy consumption can be greatly reduced. Of course, the protruding part 9 and the concave part 10 may also have other structures such as a trapezoid. The protruding part 9 cooperates with the concave part 10, and there is a gap between the bottom surface of the second mounting portion 41 and the top surface of the first mounting portion 311, so that friction between the bottom face of the second mounting portion 41 and the top face of the waterproof cover 1*d* can be reduced. Since frictional resistance can be reduced, the drive shaft 31 can drive the rotating shaft 4 stably and smoothly, and energy consumption can be effectively reduced.

Figure 2:
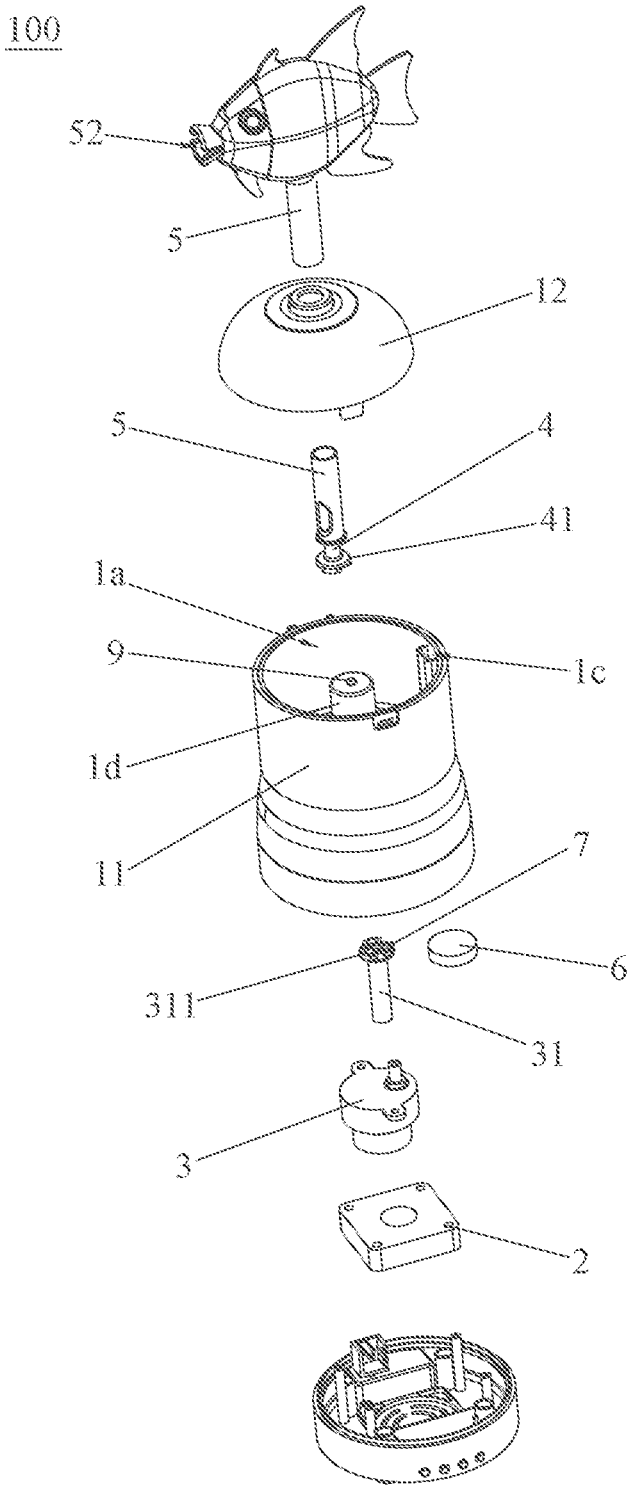
FIG. 2 is an exploded view of the rotary atomization device in FIG. 1.

As shown in FIGS. 2-3, the housing 1 includes a main body 11 and a cover body 12. A lower part of the main body 11 is provided with the containing room 1*b*, an upper part of the main body 11 is open, and the cover body 12 opens or closes on the upper part of the main body 11 and forms the atomization room 1*a* with the main body 11. By assembling the cover body 12 and the main body 11, the main body 11 can be opened or closed, so that the liquid is filled into the atomization room 1*a*, which is convenient for use. One side of the cover body 12 is pivotally connected to the main body 11, and a pivot shaft is perpendicular to the drive shaft 31, so that the cover body 12 can be mounted on the main body 11 so that the cover body 12 is flipped up and down. The cover body 12 is also provided with an engagement portion (not shown in the figure), and an upper edge of the main body 11 is also provided with a matching portion (not shown in the figure) corresponding to the engagement portion to realize detachable connection between the cover body 12 and the main body 11. By assembling the cover body 12 and the main body 11, the main body 11 can be opened or closed, so that the liquid is filled into the atomization room 1*a*, which is convenient for use. Specifically, the liquid is water, but not restricted.

Figure 5:
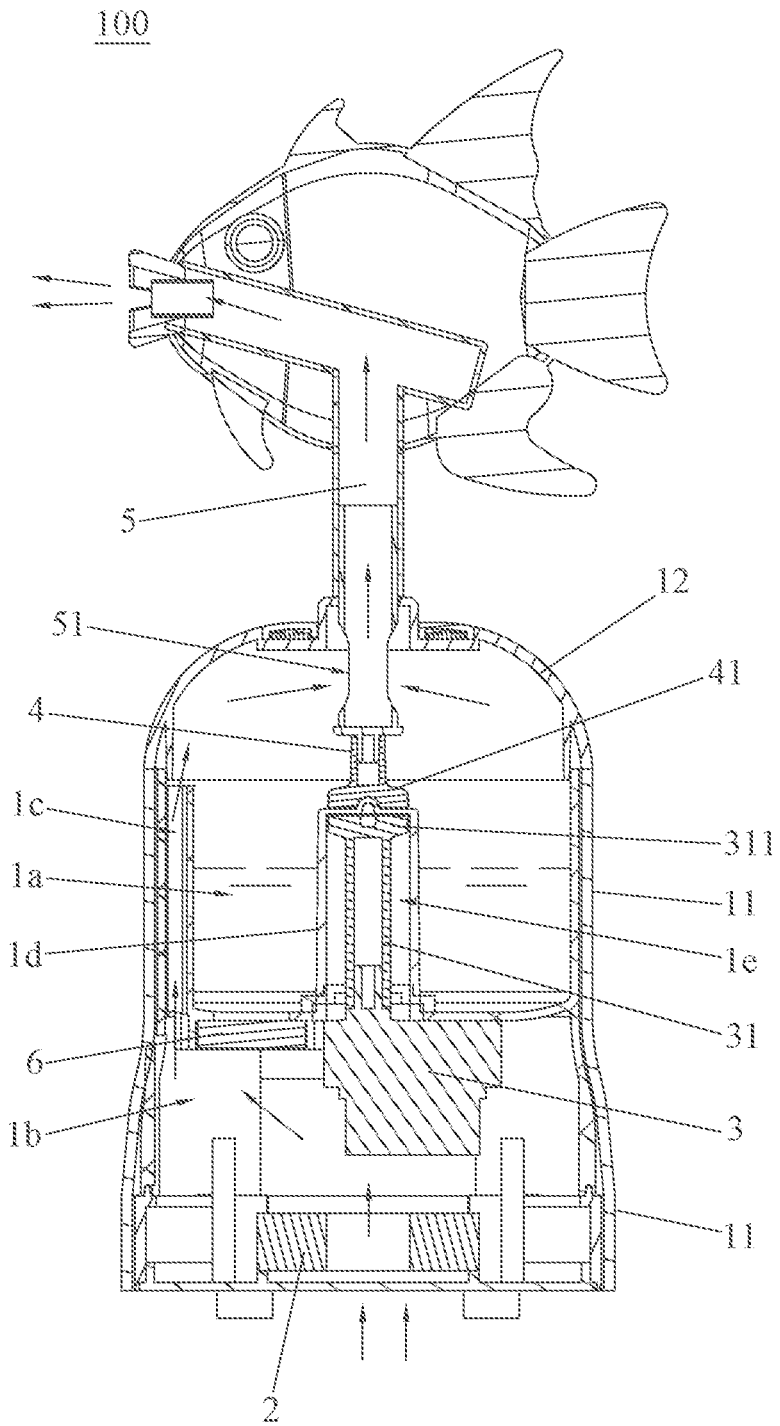
FIG. 5 is a sectional view showing a flow direction of a gas during atomization.

Referring to FIG. 5, the working principle of the rotary atomization device 100 in the first embodiment will be described in detail below.

First, user switches on, the control circuit board controls the atomizing structure 6 to work, and the atomizing structure 6 atomizes the liquid in the atomization room 1*a*, so that the space above the liquid level in the atomization room 1*a* is filled with the mist. At this time, the blowing device 2 is opened, and the blowing device 2 blows the air so that the air enters the containing room 1*b* from the bottom of the containing room 1*b*, and then enters the atomization room 1*a* from the gas channel 1*c*. At this time, pressure in the atomization room 1*a* increases, so the mist enters the gas tube 5 from the gas inlet 51 of the gas tube 5 and is discharged from the gas outlet 52 of the gas tube 5. At the same time, when the deceleration motor starts, the deceleration motor drives the drive shaft 31 to rotate, and the drive shaft 31 drives the rotating shaft 4 through the magnetic force between the first magnet 7 and the second magnet 8, and the rotating shaft 4 drives the gas tube 5 to rotate. The gas outlet 52 of the gas tube 5 can rotate 360 degrees around the central axis of the rotating shaft 4 while spraying.

In the present invention, the atomization room 1*a* and the containing room 1*b* that is used to separate the liquid of the atomization room 1*a* are arranged in the housing 1, and the gas channel 1*c* is arranged between the containing room 1*b* and the atomization room 1*a*, and the blowing device 2 is arranged in the containing room 1*b*, and the atomizing structure 6 and the gas tube 5 are arranged in the atomization room 1*a*. Therefore, after the liquid is atomized by the atomizing structure 6, the mist can be discharged from the gas tube 5 to the outside by the blowing device 2. Furthermore, the rotating drive device 3 drives the gas tube 5 to rotate, so that the gas outlet 52 of the gas tube 5 rotates to realize rotary spraying. The spraying direction can be changed continuously, so as to evenly humidify the surroundings and avoid the problem of excessive wetness and accumulation of water droplets caused by spraying towards one direction for a long time, and the use effect is ideal. In addition, the rotating spraying can also improve the viewing.

Figure 6:
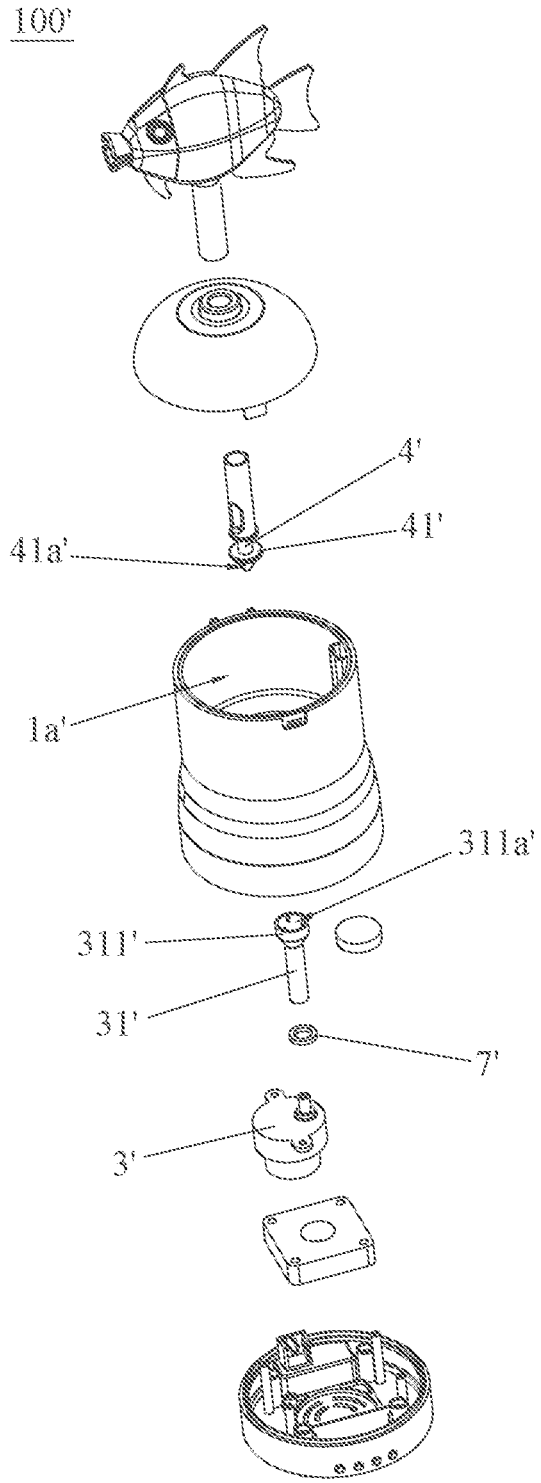
FIG. 6 is an exploded view of a rotary atomization device according to a second embodiment of the present invention.
Figure 7:
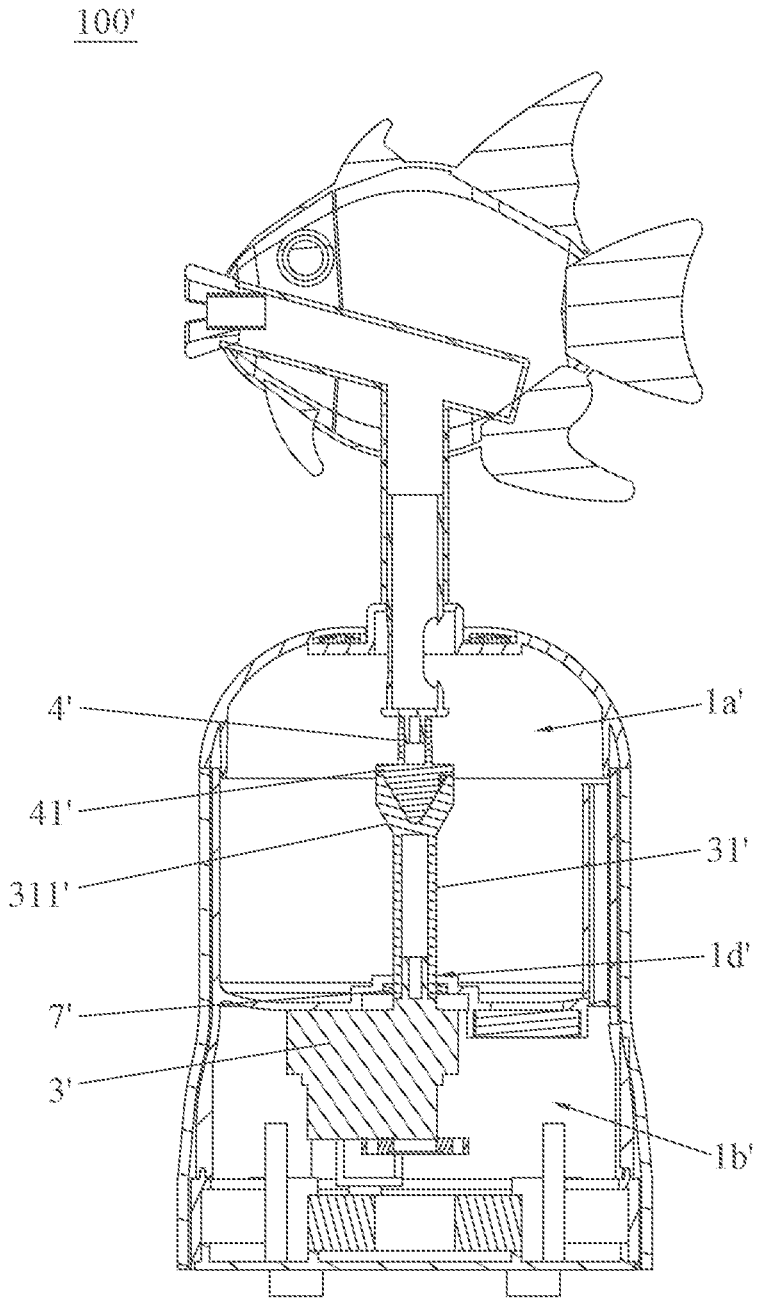
FIG. 7 is a sectional view of the rotary atomization device in FIG. 6.
Figure 8:
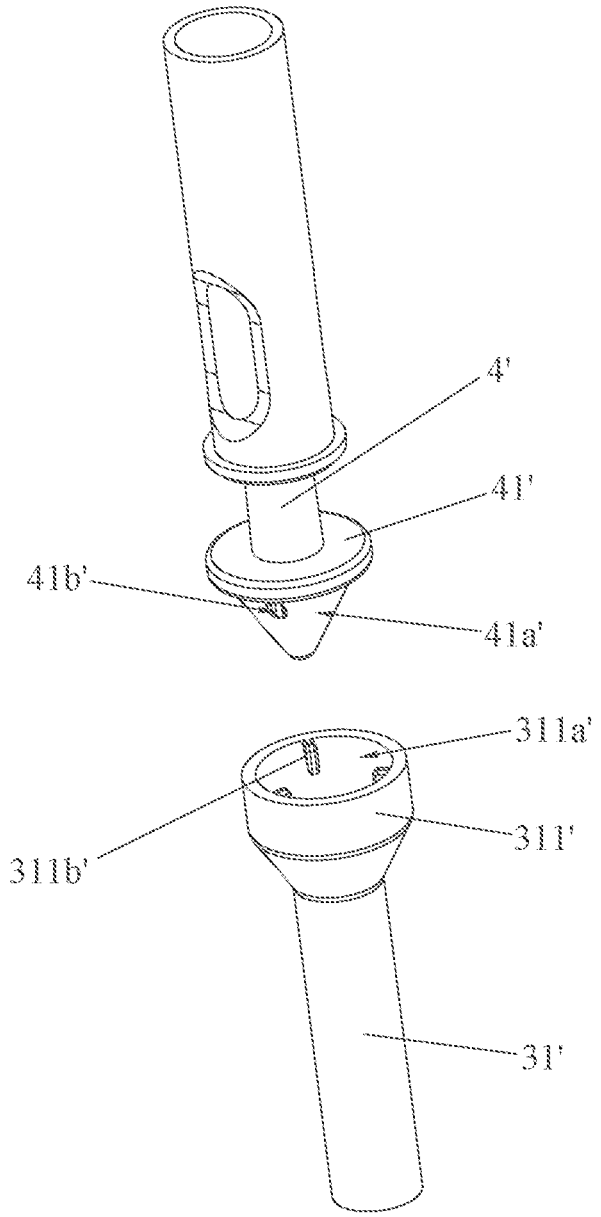
FIG. 8 is an exploded view showing a drive shaft and a rotating shaft in FIG. 6.

As shown in FIGS. 6-8, a second embodiment of a rotary atomization device 100' of the present invention is shown.

The rotary atomization device 100' in the second embodiment is basically the same as the rotary atomization device 100 in the first embodiment, and the difference between the first embodiment and the second embodiment lies in the connection method of the drive shaft 31' and the rotating shaft 4'. Specifically, in the second embodiment, the waterproof cover 1*d* in the first embodiment is cancelled, instead, a through hole 1*d'* is opened at the bottom of the atomization room 1*a'*. The drive shaft 31' penetrates from the containing room 1*b'* by the through hole 1*d'* into the atomization room 1*a'* and is connected to the rotating shaft 4'. The rotating drive device 3' is arranged in the containing room 1*b'*, and a sealing ring 7' is disposed between the drive shaft 31' and the bottom of the atomization room 1*a'*. Since the drive shaft 31' extends into the atomization room 1*a'*, there will be a gap between the drive shaft 31' and the atomization room 1*a'*. Therefore, by arranging the sealing ring 7', the gap is sealed, so as to prevent the liquid in the atomization room 1*a'* from leaking into the containing room 1*b'*, which plays a waterproof role. More specifically, one end of the drive shaft 31' facing the rotating shaft 4' is provided with a first connecting portion 311', and the rotating shaft 4' is provided with a second connecting portion 41' that can be connected with the first connecting portion 311'. The drive shaft 31' and the rotating shaft 4' can be quickly connected by the first connecting portion 311' and the second connecting portion 41'. Specifically, a top surface of the first connecting portion 311' is concaved inward to form a conical structure, and a side wall of the conical structure of the first connecting portion 311' forms a guiding inclined surface 311*a'*. A bottom surface of the second connecting portion 41' protrudes outward to form a conical structure, and a side surface of the conical structure of the second connecting portion forms the matching inclined surface 41*a'*. When the second connecting portion 41' is connected with the first connecting portion 311', the matching inclined surface 41*a'* is matched with the guiding inclined surface 311*a'*. By arranging the guiding inclined surface 311*a'* and the matching inclined surface 41*a'*, the rotating shaft 4' can be quickly positioned and connected to the drive shaft 31', thereby facilitating assembly. Preferably, the guiding inclined surface 311*a'* of the first connecting portion 311' is provided with one of a protruding portion 311*b'* and a concave portion 41*b'*. The matching inclined surface 41*a'* of the second connecting portion 41' is provided with the other one of the protruding portion 311*b'* and the concave portion 41*b'*. In this embodiment, the guiding inclined surface 311*a'* of the first connecting portion 311' has the protruding portion 311*b'*, and the number of the protruding portion 311*b'* is three. The protruding portions 311*b'* are evenly distributed around the central axis of the drive shaft 31'. The matching inclined surface 41*a'* of the second connecting portion 41' has a concave portion 41*b'* corresponding to the protruding portion 311*b'*, the number of the concave portion 41*b'* is three. The concave portions 41*b'* are distributed evenly around the central axis of the rotating shaft 4'. The concave portion 41*b'* is engaged with the protruding portion 311*b'* in the circumferential direction, and the concave portion 41*b'* and the protruding portion 311*b'* can be separated in the axial direction. In this way, the concave portion 41*b'* and the protruding portion 311*b'* can be positioned circumferentially quickly, so as to effectively transmit the torque of the drive shaft 31' to the rotating shaft 4' to drive the rotating shaft 4' to rotate. Besides, the axial separation can quickly assemble and disassemble the rotating shaft 4' from the drive shaft 31'. The working principle and effect of the rotary atomization device 100' in the second embodiment are basically the same as those of the first embodiment, and the description will not be repeated.

In addition, a third embodiment of the rotary atomization device 100' is provided. The structure of the rotary atomization device 100' in the third embodiment is basically the same as that of the first embodiment. The difference between the first embodiment and the third embodiment lies in that the rotating drive device is arranged in the atomization room, and the rotating drive device is a waterproof motor. The drive shaft can directly connect the rotating shaft. In this way, the same function and effect can also be achieved, and the description will not be repeated here.

While the invention has been described in connection with what are presently considered to be the most practical and preferred embodiments, it is to be understood that the invention is not to be limited to the disclosed embodiments, but on the contrary, is intended to cover various modifications and equivalent arrangement included within the spirit and scope of the invention.

What is claimed is:

1. A rotary atomization device, comprising a housing, a blowing device, a rotating drive device, a rotating shaft, a gas tube and an atomizing structure, wherein the housing is provided with an atomization room for storing a liquid and a containing room for separating the liquid in the atomization room, the containing room is communicated with the atomization room by a gas channel, the blowing device is arranged in the containing room, the rotating drive device is arranged in the containing room or the atomization room, a drive shaft of the rotating drive device is connected with the rotating shaft, the rotating shaft is connected with the gas tube, one end of the gas tube is arranged in the atomization room and provided with a gas inlet, and another end of the gas tube is extended out of the housing and provided with a gas outlet, the atomizing structure is disposed on a bottom of the atomization room to atomize the liquid, the blowing device blows towards the gas channel to blow a gas from the atomization room to the gas outlet through the gas inlet, and the rotating drive device drives the rotating shaft to rotate so as to drive the gas outlet of the gas tube to rotate.

2. The rotary atomization device as claimed in claim 1, wherein a waterproof cover is arranged at the bottom of the atomization room, a containing cavity is formed inside the waterproof cover, the containing cavity is communicated with the containing room and isolated from the atomization room, the rotating drive device is arranged in the containing room, and the drive shaft is arranged in the containing cavity.

3. The rotary atomization device as claimed in claim 2, wherein the drive shaft is provided with a first mounting portion, the first mounting portion is provided with at least two first magnets, the rotating shaft is disposed in the atomization room, one end of the rotating shaft facing the first mounting portion is provided with a second mounting portion, and the second mounting portion is provided with at least two second magnets that attract the at least two first magnets, so that while the drive shaft rotates, the rotating shaft is driven to rotate by a magnetic attraction.

4. The rotary atomization device as claimed in claim 3, wherein the at least two first magnets are evenly distributed around a central axis of the drive shaft, and at least two second magnets are disposed corresponding to the at least two first magnets.

5. The rotary atomization device as claimed in claim 3, wherein one of a protruding part and a concave part is provided at a center of a top face of the waterproof cover facing the second mounting portion, the other one of the protruding part and the concave part is provided at a center of a bottom face of the second mounting portion and matched with the protruding part or the concave part at a center of an end face of the waterproof cover, the protruding part and the concave part are movably connected to each other, so that a gap is defined between the bottom face of the second mounting portion and a top surface of the first mounting portion.

6. The rotary atomization device as claimed in claim 5, wherein both the protruding part and the concave part have a tapered structure, so that a pointed end of the protruding part is in a point contact with a bottom of the concave part.

7. The rotary atomization device as claimed in claim 2, wherein the waterproof cover is protruded toward an inside of the atomization room.

8. The rotary atomization device as claimed in claim 1, wherein a direction of the gas outlet of the gas tube intersects with a direction of a central axis of the rotating shaft.

9. The rotary atomization device as claimed in claim 1, wherein the rotating drive device is arranged in the containing room, the drive shaft extends into the atomization room, and a sealing ring is arranged between the drive shaft and the bottom of the atomization room.

10. The rotary atomization device as claimed in claim 9, wherein one end of the drive shaft facing the rotating shaft is provided with a first connecting portion, and the rotating shaft is provided with a second connecting portion which is connected with the first connecting portion.

11. The rotary atomization device as claimed in claim 10, wherein the first connecting portion is provided with one of a protruding portion and a concave portion, the second connecting portion is provided with the other one of the protruding portion and the concave portion, and the concave portion is circumferentially engaged with the protruding portion.

12. The rotary atomization device as claimed in claim 11, wherein the first connecting portion is formed with a guiding inclined surface, and a bottom surface of the second connecting portion is provided with a matching inclined surface matching with the guiding inclined surface.

13. The rotary atomization device as claimed in claim 12, wherein a top surface of the first connecting portion is concaved inward to form a conical structure, and a side wall of the conical structure of the first connecting portion forms the guiding inclined surface, a bottom surface of the second connecting portion protrudes outward to form a conical structure, and a side surface of the conical structure of the second connecting portion forms the matching inclined surface.

14. The rotary atomization device as claimed in claim 1, wherein the rotating drive device is arranged in the atomization room, and the rotating drive device is a waterproof motor.

15. The rotary atomization device as claimed in claim 1, wherein the housing comprises a main body and a cover body, a lower part of the main body is provided with the containing room, the cover body opens or closes on an upper part of the main body, and forms the atomization room with the main body.

* * * * *